US005502430A

United States Patent [19]

Takahashi et al.

[11] Patent Number: 5,502,430

[45] Date of Patent: Mar. 26, 1996

[54] FLAT TRANSFORMER AND POWER SUPPLY UNIT HAVING FLAT TRANSFORMER

[75] Inventors: Tadashi Takahashi; Kenichi Onda, both of Hitachi; Akihiko Kanouda, Katsuta; Hideaki Horie, Hitachi; Syuya Hagiwara, Mito; Noriyuki Uchiyama; Sadamu Saito, both of Hitachi, all of Japan

[73] Assignee: Hitachi, Ltd., Tokyo, Japan

[21] Appl. No.: 141,628

[22] Filed: Oct. 27, 1993

[30] Foreign Application Priority Data

Oct. 29, 1992 [JP] Japan ..... 4-291124

[51] Int. Cl.[6] ..... H01F 27/28

[52] U.S. Cl. ..... 336/232; 336/225; 336/198

[58] Field of Search ..... 336/232, 198, 336/199, 220, 225

[56] References Cited

U.S. PATENT DOCUMENTS

| | | | |
|---|---|---|---|
| 2,064,771 | 12/1936 | Vogt | 336/232 |
| 2,847,651 | 8/1958 | Schamanek | 336/200 |
| 3,458,650 | 7/1969 | Miyawaki | 336/220 X |
| 3,611,233 | 8/1969 | Haldeman, Jr. | 336/188 |
| 4,785,345 | 11/1988 | Rawls et al. | 29/34 |
| 5,175,525 | 12/1992 | Smith | 336/83 |
| 5,359,313 | 10/1994 | Watanabe et al. | 336/178 |

*Primary Examiner*—Laura Thomas

*Attorney, Agent, or Firm*—Antonelli, Terry, Stout & Kraus

[57] ABSTRACT

A flat transformer has a coil body. The coil body is formed by winding plural insulated conductive wires. Each of the plural insulated conductive wires has a conductor having a circular shaped cross-section, and an outer peripheral portion of the conductor is coated by an insulating coating. A part of plural insulated conductive wires is used to form a primary winding and the remainder of the plural insulated conductive wires is used to form a secondary winding. A flat transformer may also have plural coil bodies. The plural coil bodies may be wound at plural stages. A part of the plural coil bodies is may be used to form a primary winding and the remainder of plural coil bodies may be used to form a secondary winding. The flat transformer can operate stably at a high frequency with a small loss.

35 Claims, 13 Drawing Sheets

FLAT TRANSFORMER AND POWER SUPPLY UNIT HAVING FLAT TRANSFORMER

BACKGROUND OF THE INVENTION

The present invention relates to a flat transformer, and a power supply unit having a flat transformer. Further, the present invention relates to a flat transformer, and a portable information processing system and apparatus having a power supply unit, such as an office automation system and apparatus and an audio-visual system and apparatus.

In a conventional flat transformer, for example as disclosed in Japanese patent laid-open No. 42,907/1992, three foils having wide widths are insulated respectively and these three foils are contacted and wound. After winding these foils, the foils are cut down and thereby a square shape cross-section flat coil body is obtained.

A part of the coil body is used as a primary winding of the flat transformer and another part of the coil body is used as a secondary winding of the flat transformer, resulting in a flat transformer construction.

However, in the flat transformer obtained by the above stated conventional technique, since the coil body is disposed in a single plane, when the winding ratio between the primary winding and the secondary winding of the transformer exceeds more than 1:3, there appears a phenomenon in which the secondary winding does not contact the primary winding directly.

In the above mentioned case, the magnetic coupling between the primary winding and the secondary winding becomes extremely poor and thereby it causes a problem in which a required characteristic as a flat transformer can not be attained, because of a loss due to the poor electric power transmission.

Further, when a multi-output having more than three outputs is taken in a flat transformer, more than four conductors are required, resulting in a problem similar to the above stated problem.

Further, in the above described conventional transformer, the coil body is coated by an insulating member only at an inner side peripheral portion in which an adjacent coil body is contacted directly through the insulating member from a side direction. However, the coil body in the prior art is not coated by the insulating member at an upper face and a lower face thereof. Thereby, in the prior technique, it is impossible to overlap the coil bodies in both an upward direction and also a downward direction.

In a power supply unit in a personal apparatus, such as an office automation system and apparatus and an audio-visual system and apparatus, since a multi-output having various output voltages is required, there is a problem when the power supply unit is constituted with use of a flat transformer of the above stated conventional construction.

Further, in the flat transformer of the above stated conventional construction, since both a cross-section of a conductor of the primary winding and a cross-section of a conductor of the secondary winding are formed with a square shape, respectively, the electrostatic capacity between the primary winding and the secondary winding becomes large.

As a result, when the flat transformer in the prior art is used in a high frequency condition, in addition to the magnetic coupling characteristic of the flat transformer, a magnetic coupling between the primary winding and the secondary winding occurs due to the above electrostatic capacity and an oscillating phenomenon is generated between the electrostatic capacity and an inductance of an outside circuit such as a driving circuit.

Accordingly, in the conventional flat transformer, it is difficult to operate with the high frequency condition, and when it operates in a high frequency the loss increases and thereby it causes a problem in that it can not obtain a high efficiency in the flat transformer operation.

SUMMARY OF THE INVENTION

An object of the present invention is to provide a flat transformer and a power supply unit having a flat transformer, wherein a large magnetic coupling force between a primary winding and a secondary winding can be obtained, and the flat transformer can be operated stably.

Another object of the present invention is to provide a flat transformer wherein under a high frequency condition, a magnetic coupling between a primary winding and a secondary winding caused an electrostatic capacity can be made small and the flat transformer can be operated stably.

A further object of the present invention is to provide a flat transformer and a power supply unit having a flat transformer, wherein an oscillating phenomenon in the flat transformer is not generated and the flat transformer can be operated stably.

A further object of the present invention is to provide a flat transformer and a power supply unit having a flat transformer wherein a predetermined characteristic in the flat transformer can not be damaged and the winding ratio of more than 1:3 between the primary winding and the secondary winding can be obtained.

A further object of the present invention is to provide a flat transformer and a power supply unit having a flat transformer wherein a multi-output of the flat transformer can be obtained.

A further object of the present invention is to provide a power supply unit having a flat transformer wherein a small size and a thin type power supply unit construction can be obtained.

According to the present invention, a flat transformer has a coil body formed by plural insulated conducting wires. Each of the plural insulated conducting wires has a conductor in an interior portion and the conductor of the insulated conducting wire is coated by an insulating member in an outer peripheral portion. The coil body is formed spirally by winding the plural insulated conducting wires in a plane. A part of the plural insulated conducting wires is used to form a primary winding of the flat transformer, and the remainder of the plural insulated conducting wires is used to form a secondary winding of the flat transformer.

According to the present invention, a flat transformer has plural coil bodies formed by plural insulated conducting wires. Each of the plural insulated conducting wires has a conductor in an interior portion and the conductor of the insulated conducting wire is coated by an insulating member in an outer peripheral portion. Each of the plural coil bodies is formed spirally by winding the plural insulated conducting wires in a plane and the plural coil bodies are wound spirally at plural stages. A part of the plural coil bodies is used to form a primary winding of the flat transformer, and the remainder of the plural coil bodies is used to form a secondary winding of the flat transformer.

According to the present invention, a flat transformer has plural coil bodies formed by plural insulated conducting wires. Each of the plural insulated conducting wires has a conductor in an interior portion and the conductor of the insulated conducting wire is coated by an insulating member in an outer peripheral portion. Each of the plural coil bodies is formed spirally by winding the plural insulated conducting wires and the plural coil bodies are wound spirally at plural stages. A part of the plural insulated conducting wires is used to form a primary winding of the flat transformer, and the remainder of the plural insulated conducting wires is used to form a secondary winding of the flat transformer.

According to the present invention, a power supply unit has a flat transformer. The flat transformer is used in a voltage converting unit in the power supply unit. Further, according to the present invention, the above stated power supply unit having the flat transformer is used in a power supply unit source of a portable information processing system and apparatus, such as a personal computer, a word processor and a disk apparatus.

According to the present invention, since, in the flat transformer construction, the plural insulated conductive wires are disposed adjacently and closely to form primary winding and secondary winding in plane, the flat transformer can be disposed with no clearance toward the thickness direction and with no iron core, and the flat transformer can be comprised of only conductors. Accordingly, it is possible to obtain a thin type flat transformer construction.

Since the conductor of the primary winding and the conductor of the secondary winding are disposed closely and adhesively, in a case in which the flat transform is used in a high frequency condition, the high frequency current can flow into both the conductor of the primary winding and the conductor of the secondary winding. Due to the surface effect, the current flowing interval between a conductor of the adhered primary winding and the adhesively adjacent conductor of the secondary winding becomes very small, thereby a good magnetic coupling between the primary winding and the secondary winding can be obtained.

Even when the flat transformer has no iron core formed by a magnetic material, most of the magnetic flux formed by the primary winding caught or intercepted by the secondary winding. Thereby, a high magnetic coupling between the primary winding and the secondary winding can be obtained, and since no iron loss exists in the flat transformer, a high efficiency in the operation of the flat transformer can be obtained.

Further, since each of the primary winding and the secondary winding is formed by a insulated conductive wire having a circular cross-section, for example, the primary conductive wire and the secondary conductive wire are disposed adjacently and is contact only under a point-contact state.

Accordingly, the electrostatic capacity between the primary conductive wire and the secondary conductive wire can be reduced to a minimum value, so that even under a high frequency condition, the flat transformer can be operated stably.

Further, using the coil bodies wound at plural stages or the complex conductive wire wound concentrically and spirally, the conductive wire of the secondary winding can be wound a plural times by contacting the surface of the conductive wire of the primary winding.

Accordingly, without spoiling the characteristic of the flat transformer, a large winding ratio of the flat transformer under the connecting condition of the secondary winding can be obtained, and further a multi-output in the flat transformer can be obtained.

Further, since the flat transformer obtained by the present invention is disposed on the same substrate member on which the power supply circuit components are mounted, a slim type power supply unit can be obtained. Since this power supply unit is employed in the power supply unit source of a portable information processing system and apparatus, such as a personal computer, a word processor and a disk apparatus, a slim type information processing system and apparatus as a whole can be obtained.

DESCRIPTION OF THE INVENTION

One embodiment of a flat transformer according to the present invention will be explained with reference to FIG. 1A, FIG. 1B, FIG. 2 and FIG. 3.

Figure 1A:
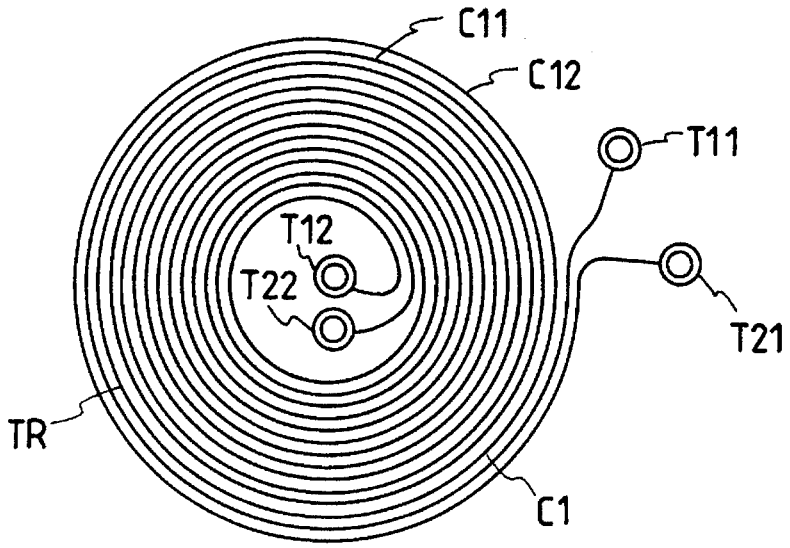
FIG. 1A is a plan view showing one embodiment of a winding construction for a flat transformer having a coil body according to the present invention.
Figure 1B:
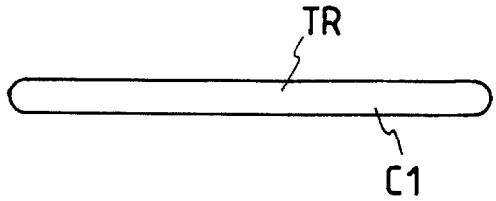
FIG. 1B is a side view showing the embodiment of the winding construction having the coil body as shown in FIG. 1A.

In FIG. 1A, each of a conductor of a first insulated conducting wire C11 and a conductor of a second insulated conducting wire C12 has a circular shape cross-section, respectively. The first insulated conducting wire C11 and the second insulated conducting wire C12 run in parallel and are constituted adjacently. Each of the first and the second conducting wires C11 and C12 are coated by insulating material along the whole outer peripheral portion thereof. By winding the first and the second insulated conducting wires C11 and C12 as a pair in a spirit on the same plane, a coil body C1 is formed.

A terminal T11 is provided at one end of the first insulated conducting wire C11 and a terminal 12 is provided the other end of the first insulated conducting wire C11. A terminal T21 is provided at one end of the second insulated conducting wire C12 and a terminal T22 is provided at the other end of the second insulated conducting wire C12.

The first insulated conducting wire C11 forms a primary winding and the second insulated conducting wire C12 forms a secondary winding, so that a flat transformer TR is formed.

In this embodiment of the flat transformer TR according to the present invention, a conductor having the circular shaped cross-section is employed, however a conductor having a polygon shaped cross-section, including a square shaped cross-section and an elliptic shaped cross-section etc. can be employed.

Figure 2:
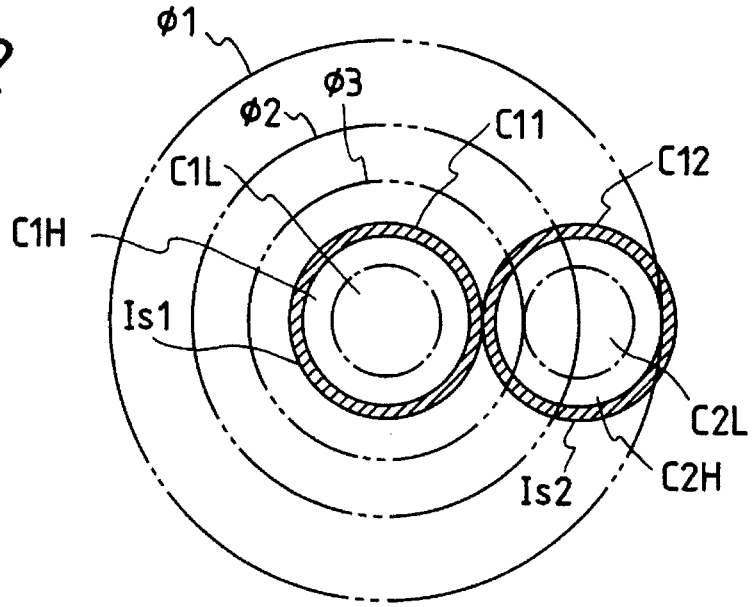
FIG. 2 is a diagrammatic view showing a magnetic coupling between a primary winding and a secondary winding of the type shown in FIG. 1A and FIG. 1B.

FIG. 2 is an explanatory view showing the magnetic flux distribution around conductors, in which each of the primary winding C11 and the secondary winding C12 is shown in a cross-sectional state.

As shown in FIG. 2, an insulating coating film Is1 is disposed around the entire outer peripheral portion of the primary winding C11, and an insulating coating film Is2 is disposed around the entire outer peripheral portion of the secondary winding C12, respectively. The primary winding C11 and the secondary winding C12 are disposed adjacently and are adhesively coupled through the insulating coating film Is1 and the insulated coating film Is2.

When an alternating current is supplied to the primary winding C11, in a case of the a frequency condition, since the surface effect is small, the electric current is applied across the entire cross-section (this cross-section is divided into a central portion C1L and a peripheral portion C1H for purposes of explanation) of the primary winding C11.

Accordingly, under a low frequency condition, as shown in FIG. 2, the magnetic flux $\phi 1$ produced by the central portion C1L and the peripheral portion C1H of the primary winding C11 encloses both a central portion C2L and a peripheral portion C2H of the cross-section of the secondary winding C12.

However, the magnetic flux $\phi 2$ and the magnetic flux $\phi 3$ do not enclose the entire central portion C2L and the entire peripheral portion C2H of the secondary winding C12, so that the secondary winding C12 does not catch all of the magnetic flux $\phi 1$ made by the primary winding C11.

Besides, under a high frequency condition, due to the surface effect the electric current does not flow into the central portion C1L of the primary winding C11, but flows collectively in the peripheral portion C1H of the primary winding C11. As a result, the magnetic flux $\phi 1$ formed by the primary winding C11 is caught easily by the secondary winding C12.

Further, at the secondary winding C12, the electric current flows only on a surface of the peripheral portion C2H of the conductor of the secondary winding C12 as a result of the surface effect, similarly to that of the primary winding C11.

As a result, during high frequency operation, as shown in FIG. 2, the magnetic fluxes $\phi 1$, $\phi 2$ and $\phi 3$ formed by the conductor of the peripheral portion C1H of the primary winding C11 enclose all of the peripheral portion C2H of the secondary winding C12.

Since the secondary winding C12 can catch all of the magnetic fluxes $\phi 1$, $\phi 2$ and $\phi 3$, a good magnetic coupling between the primary winding C11 and the secondary winding C12 can be obtained.

Accordingly, the voltage converting effect between the primary winding C11 and the secondary winding C12 can be improved. Further, as shown in FIG. 1A, by winding the first and the second insulated conducting wires C11 and C12 as a pair in a spiral, since the magnetic flux which passes through an inner peripheral portion of the spiral winding crosses all of the conductors, the magnetic coupling efficiency in the flat transformer TR can be improved, and also the voltage converting effect in the flat transformer TR can be improved.

Figure 3:
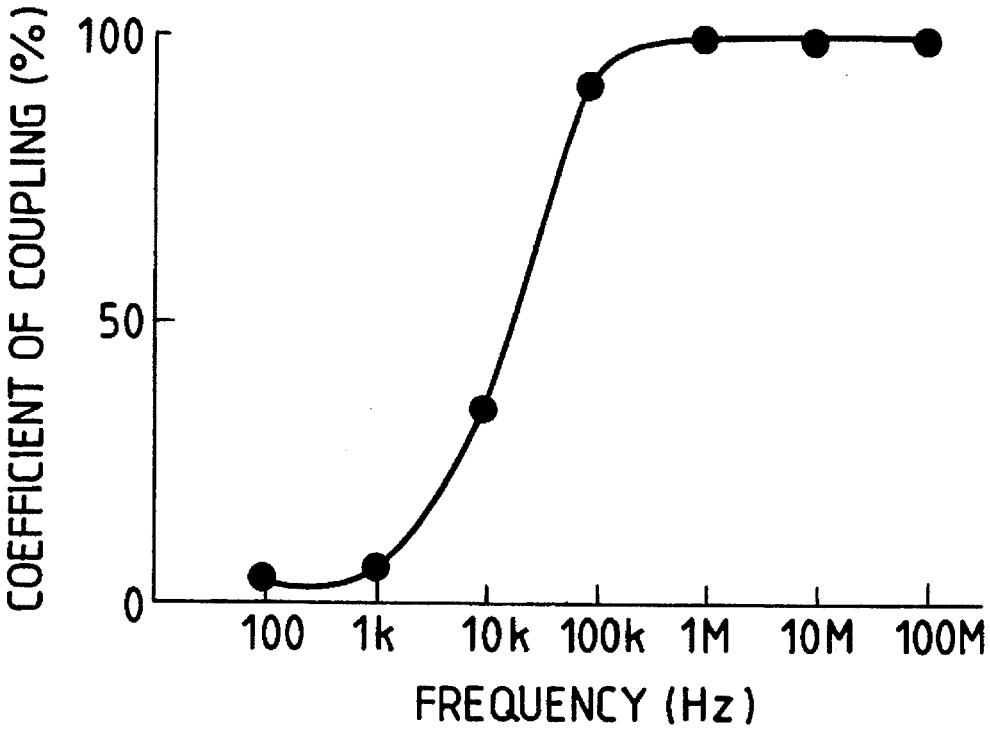
FIG. 3 is a characteristic diagram showing a relationship between frequency and a coefficient of coupling in the flat transformer shown in FIG. 1A and FIG. 1B.

FIG. 3 is a characteristic view showing one example of the coupling efficiency of the primary winding C11 and the secondary winding C12 with respect to the frequency in the flat transformer TR according to the present invention.

As shown in FIG. 3, the magnetic coupling efficiency becomes good abruptly at frequencies above 10 kH, and the magnetic coupling efficiency becomes nearly about 100% at frequencies exceeding 100 kH.

According to the above embodiment of the flat transformer TR of the present invention, no iron-loss of the flat transformer TR occurs under the high frequency condition. Further, a high efficiency flat transformer TR having and a simple flat construction can be obtained.

Figure 4A:
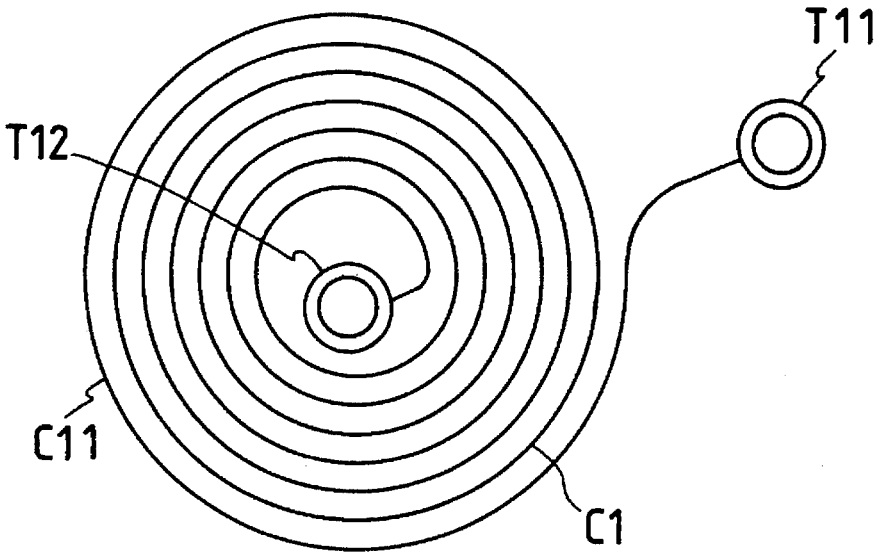
FIG. 4A is a plan view showing another embodiment of a winding construction of an upper side coil body a flat transformer having a pair of coil bodies according to the present invention.

FIG. 4A shows a winding arrangement a one coil body for a flat transformer according to the present invention.

Figure 4B:
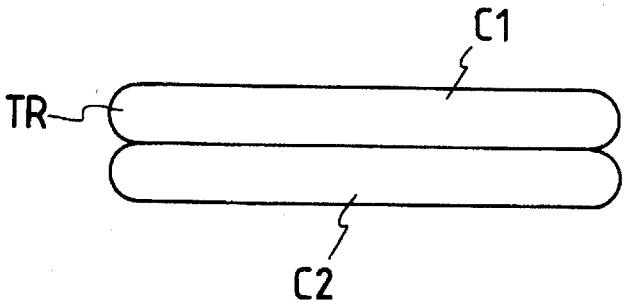
FIG. 4B is a front view showing the embodiment of the winding construction having two coil bodies shown in FIG. 4A.
Figure 4C:
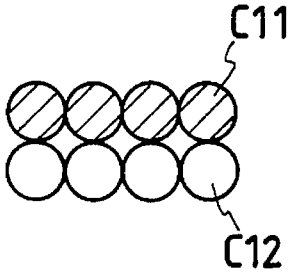
FIG. 4C is a cross-sectional view of the conductor construction arrangement of the winding construction as shown in FIG. 4A and FIG. 4B.

In FIG. 4A–4C, each of the above stated insulated conducting wires C11 and C12 shown in the former embodiment is wound independently and spirally on a respective plane, and a pair of coil bodies C1 and C2 are laminated adhesively in two stages including an upper stage and a lower stage. Accordingly, a flat transformer TR is constituted by the upper stage coil body C1 as a primary winding and the lower stage coil body C2 as a secondary winding.

The effects obtained by the above stated winding arrangement according to the present invention are similar to the obtained in the former embodiment explained with reference to FIG. 2 and FIG. 3.

Further, in addition to the above effects, since the above stated coil bodies C1 and C2 can be laminated in two stages in accordance with the purpose of use thereof, the winding ratio (voltage ratio) between the primary winding C11 and the secondary winding C12 can be changed freely, and further a multi-output structure flat transformer TR can be realized.

Figure 5A:
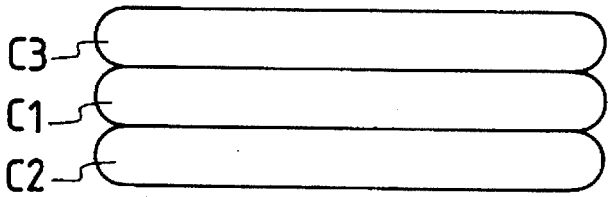
FIG. 5A is a front view showing another embodiment of a winding construction having three coil bodies.
Figure 5B:
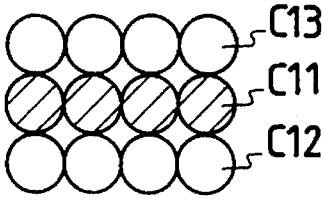
FIG. 5B is a cross-sectional view of the conductor construction arrangement of the winding construction as shown in FIG. 5A.

In FIG. 5A and FIG. 5B, each of the insulated conducting wires C11, C12 and C13 is wound independently and spirally on a respective plane, and the wound coil bodies C1, C2 and C3 are laminated adhesively in three stages including a middle stage, a lower stage and an upper stage. Accordingly, a flat transformer TR is constituted by using the middle stage coil body C1 as a primary winding and both the lower stage coil body C2 and the upper stage coil body C3 as secondary windings.

Figure 6A:
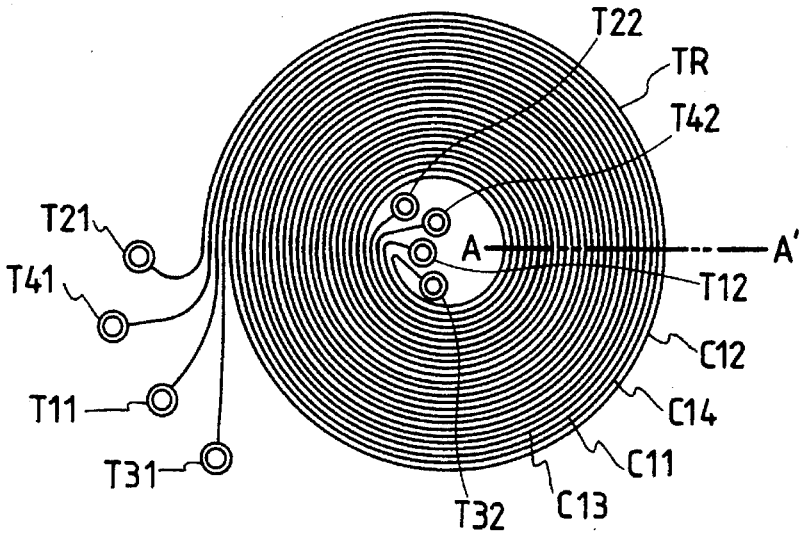
FIG. 6A is a plan view showing a further embodiment of a winding construction for a flat transformer having two stages of conductors according to the present invention.

FIG. 6A shows another winding arrangement for a flat transformer according to the present invention.

In FIG. 6A, each of four insulated conducting wires C11, C12, C13 and C14 has a circular shaped conductor cross-section and is insulated by being coating respectively by an insulating material. By winding the four insulated conducting wires C11, C12, C13 and C14 while in contact with each other, a flat transformer TR is constituted.

Figure 6B:
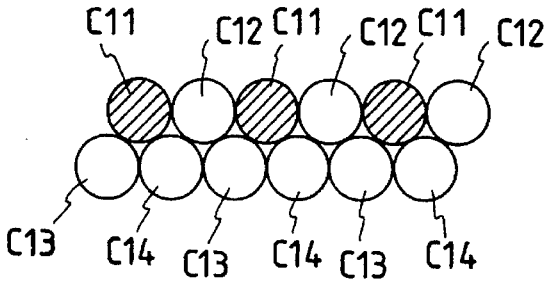
FIG. 6B is a cross-sectional view of the conductor construction arrangement of the winding construction as shown in FIG. 6A.

FIG. 6B is a cross-sectional view showing the conductor arrangement of the embodiment of FIG. 6A, showing an arrangement of the four insulated conducting wires C11, C12, C13 and C14.

As shown in FIG. 6B, each of the four insulated conducting wires C11, C12, C13 and C14 has the same conducting wire diameter. Two insulated conducting wires C11 and C12 are disposed on an upper stage in the same plane and two insulated conducting wires C13 and C14 are disposed on a lower stage in the same plane, respectively.

Further, the two insulated conducting wires C11 and C12 and the two insulated conducting wires C13 and C14 are form respective stages comprised of an upper stage and a lower stage which are offset from other by a half diameter part of a conducting wire.

The flat transformer TR is formed by using the insulated conducting wire C11 as a primary winding and the insulated conducting wires C12, C13 and C14 as secondary windings. As shown in FIG. 6B, each of the secondary windings C12, C13 and C14 contacts the primary winding C11 directly.

A terminal T11 is provided on one end of the insulated conducting wire C11 and a terminal T21 is provided on one end of the insulated conducting wire C12. Further, a terminal T31 is provided on one end of the insulated conducting wire C13 and a terminal T41 is provided on one end of the insulated conducting wire C14.

Accordingly, in the above stated embodiment according to the present invention, the electromagnetic relationship between the primary winding C11 and the secondary windings C12, C13 and C14 provides a good magnetic coupling between the primary winding C11 and the secondary windings C12, C13 and C14 similarly to the embodiment explained by reference to FIG. 2B and FIG. 3.

In the flat transformer construction TR shown in FIG. 6B, among the four conductor wires C11, C12, C13 and C14, one conducting wire C11 is used to form the primary winding and the remaining three conducting wires C12, C13 and C14 are used to form the secondary winding.

According to the arrangement shown in FIG. 6A and FIG. 6B of the present invention, each of the insulated conducting wires C12, C13 and C14 can be connected in series, so that a winding ratio of 1:3 can be obtained. Further, when an output is taken from each of the insulated conducting wires C12, C13 and C14, three outputs having a winding ratio of 1:1 can be obtained. As stated above, many output arrangement matching the intended use of the flat transformer can be obtained.

In addition to the above stated effects, since the conductor of each stage is offset as shown in FIG. 6B, the width (t) of the flat transformer shown in this embodiment may be expressed according to the following formula (1):

$$t=D+(m-1)\times(3/2)\times D \quad (1)$$

wherein, t is the width of flat transformer, D is the diameter of a conductor, m is the number of stages.

The width (t) of the flat transformer structure TR shown in this embodiment is made smaller than the width (m×D) of the flat transformer structure shown in FIG. 4B.

Figure 7:
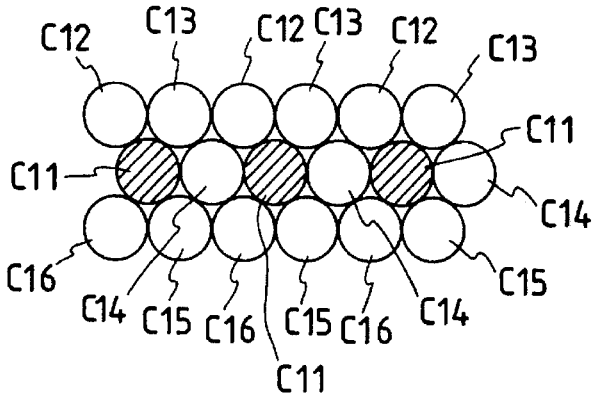
FIG. 7 is a cross-sectional view of a further embodiment of a conductor construction arrangement for a flat transformer according to the present invention.

FIG. 7 is a cross-sectional view showing a conductor arrangement constituted by six insulated conducting wires C11, C12, C13, C14, C15 and C16.

As shown in FIG. 7, each of the six insulated conducting wires C11, C12, C13, C14, C15 and C16 has the same conductive wire diameter contact each other, and are disposed in three stages.

Namely, two insulated conducting wires C11 and C14 are disposed on a middle stage in the same plane, two insulated conducting wires C12 and C13 are disposed in an upper stage in the same plane, and two insulated conducting wires C15 and C16 are disposed in a lower stage in the same plane, respectively.

Further, each position of the two insulated conducting wires C11 and the C15 and two insulated conducting wires C12 and the C14 and two insulated conducting wires C15 and C16 is offset by a half diameter of a conducting wire, respectively, from the conductors in the adjacent stage or stages.

In the flat transformer structure shown in FIG. 7, among the six insulated conducting wires C11, C12, C13, C14, C15 and C16, one insulated conducting wire C11 is used as the primary winding and the remaining five insulated conducting wires C12, C13, C14, C15 and C16 are used as the secondary windings. Five insulated conducting wires C12, C13, C14, C15 and C16 are disposed at a peripheral surrounding portion of the insulated conducting wire C11 and contact the insulated conducting wire C11.

According to the above embodiment, as shown in FIG. 7, a good magnetic coupling between the primary winding C11 and the secondary windings C12, C13, C14, C15 and C16 can be obtained and also the thickness of the flat transformer can be made thin. In addition to the above stated effects, when the primary winding C11 and the secondary windings C12, C13, C14, C15 and C16 have the same conductive wire diameter, a winding ratio of 1:5 can be obtained or five outputs a ratio of 1:1 can be obtained.

Figure 8:
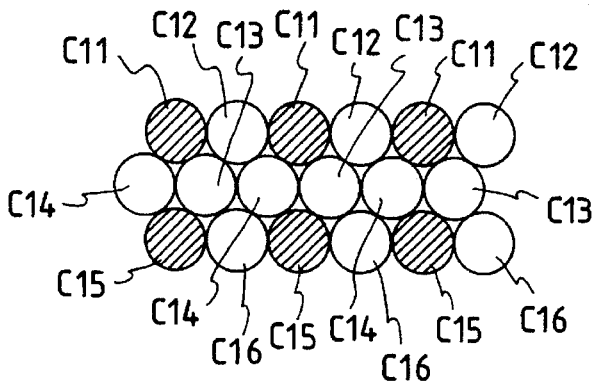
FIG. 8 is a cross-sectional view of a further embodiment of a conductor construction arrangement for a flat transformer according to the present invention.

FIG. 8 is a further cross-sectional view showing a conductor arrangement constituted by six insulated conducting wires C11, C12, C13, C14, C15 and C16.

As shown in FIG. 8, each of the six insulated conducting wires C11, C12, C13, C14, C15 and C16 has the same conductive wire diameter. Two insulated conducting wires C11 and C12, two insulated conducting wires C13 and C14 and two insulated conducting wires C15 and C16 are disposed respectively in three stages.

In the flat transformer structure shown in FIG. 8, two insulated conducting wires C11 and C15 are used to form the primary winding and four conducting wires C12, C13, C14 and C16 are used to form the secondary windings.

Further, each position of the two insulated conducting wires C11 and C12 and two insulated conducting wires C13 and C14 and the two insulated conducting wires C15 and C16 is offset by a half diameter part of the insulated conducting wire, respectively.

In the above stated flat transformer construction, since both of the primary windings C11 and all of C15 and the secondary windings C12, C13, C14 and C16 directly contact each other, a good magnetic coupling between the primary windings C11 and C15 and the secondary windings C12, C13, C14 and C16 can be obtained. Further, by selectively changing the connection of the primary windings C11 and C15 and the secondary windings C12, C13, C14 and C16 in series or in parallel, a winding ratio having 1:1–1:5 can be selected.

Figure 9:
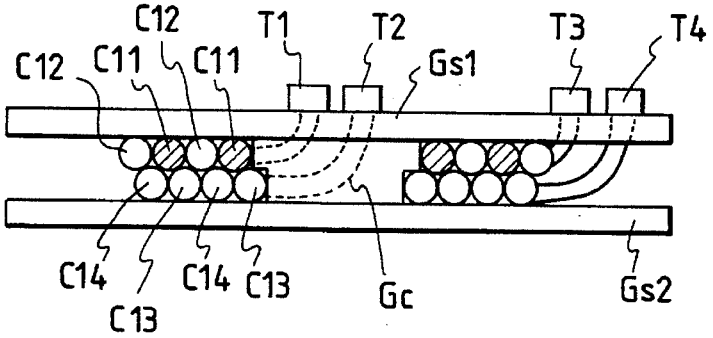
FIG. 9 is a cross-sectional view of an embodiment of a flat transformer having two stages of conductors, a bobbin and a pair of guiding plates according to the present invention.

FIG. 9 is a cross-sectional view showing an embodiment of a flat transformer TR constituted by four insulated conducting wires C11, C12, C13 and C14.

In this flat transformer construction TR shown in FIG. 9, one insulated conducting wire C11 is used as the primary winding and three insulated conducting wires C12, C13 and C14 are used as the secondary winding.

The flat transformer TR shown in FIG. 9 has a space and a bobbin GC is inserted into the space. The bobbin GC has an outer peripheral shape adjacent the windings of two different levels. The step of the different levels of the bobbin GC is equal to just a half diameter of the insulated conducting wire.

Further, two guide plate Gs1 and Gs2 are provided on an upper face and a lower face of the bobbin GC, respectively. Four terminals T1, T2, T3 and T4 for drawing out the insulated conducting wires C11, C12, C13 and C14 are provided on the guide plate Gs1. The terminals T1, T2, T3 and T4 may be provided on the guide plate Gs2 or on the bobbin GC.

With the above stated flat transformer construction TR, by winding the conducting wires C11, C12, C13 and C14 around the outer peripheral portion of the bobbin GC, the flat transformer TR can be manufactured easily. Further, by the provision of the guide plates Gs1 and Gs2, an effective electrical and mechanical protection for the insulated conducting wires C11, C12, C13 and C14 can be obtained.

Besides, in FIG. 9 after the guide plates Gs1 and Gs2 are manufactured, if the guide plates Gs1 and Gs2 become unnecessary, they may be eliminated without suffering an inconvenience in the formation of the flat transformer TR.

Figure 10:
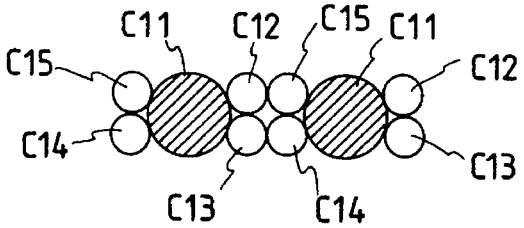
FIG. 10 is a cross-sectional view of a further embodiment of a conductor construction arrangement for a flat transformer according to the present invention.

FIG. 10 is a cross-sectional view showing further conductor arrangement for a flat transformer constituted by five insulated conducting wires C11, C12, C13, C14 and C15.

In this arrangement according to the present invention, insulated conductor wires having different conducting wire diameters are exemplified. As shown in FIG. 10, four insulated conducting wires C12, C13, C14 and C15 have the same small conducting wire diameter, while one insulated conducting wire C11 has a large conducting wire diameter.

The diameter of the four insulated conducting wires C12, C13, C14 and C15 is selected to be half of the conducting wire diameter of the insulated conducting wire C11. The construction shown in FIG. 10 shows times wound parts of the cross-sectional flat winding arrangement in which four insulated conducting wires C12, C13, C14 and C15 having the same small conducting wire diameter and one insulated conducting wire C11 having a large conducting wire diameter are wound spirally.

In this used as transformer construction shown in FIG. 10, one insulated conducting wire C11 is performed to form the primary winding and four insulated conducting wires C12, C13, C14 and C15 are used as the secondary winding.

In the above stated flat transformer construction, since the secondary windings C12, C13, C14 and C15 directly contact each other, a good magnetic coupling between the primary windings C11 and the secondary winding C12, C13, C14 and C15 can be obtained.

Further, the occupy ratio of the conductor can be increased in comparison with the former embodiments in which both the primary winding C11 and the secondary winding C12, C13 and C14 have the same conducting wire diameter, and thereby a small size and thin flat transformer can be obtained.

In the structure shown in FIG. 10, when the primary winding is formed by one conducting wire C11 and the secondary winding is formed by four insulated conducting wires C12, C13, C14 and C15, which are connected in series, a winding ratio of 1:4 can be obtained.

Besides, with the flat transformer construction shown in FIG. 10, when the secondary windings C12 and C13 are connected in parallel and the secondary windings C14 and C15 are connected in parallel, and when the secondary windings C12 and C13 are connected in series to the secondary windings C14 and C15, a winding ratio of 1:2 can be obtained.

Figure 11:
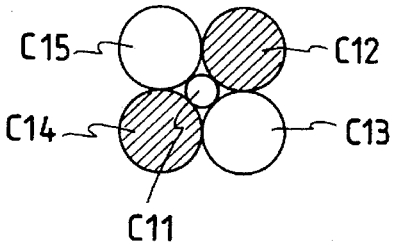
FIG. 11 is a cross-sectional view of a further embodiment of a conductor construction arrangement for a flat transformer according to the present invention.

FIG. 11 is a cross-sectional view showing a conductor arrangement of a further embodiment for a flat transformer constituted by five insulated conducting wires C11, C12, C13, C14 and C15.

In this embodiment transformer according to the present invention, insulated conducting wires having different diameters are exemplified. As shown in FIG. 11, four insulated conducting wires C12, C13, C14 and C15 have the same large conducting wire diameter, and one insulated conducting wire C11 has a small conducting wire diameter.

The diameter of the four insulated conducting wires C12, C13, C14 and C15 is selected to have a diameter which is ($\sqrt{2}-1$) times the conducting wire diameter of the insulated conducting wire C11. In a cross-sectional flat transformer using the conductor arrangement shown in FIG. 11, four insulated conducting wires C12, C13, C14 and C15 having the same large conducting wire diameter are wound spirally so as to surround the one insulated conducting wire C11 having the small conducting wire diameter.

In a the flat transformer using the conductor structure shown in FIG. 11, the two insulated conducting wires C12 and C14 are used as the primary winding and the three insulated conducting wires C11, C13 and C15 are used as the secondary winding.

In the above stated flat transformer construction, since the primary windings C12 and C14 and the secondary windings C11, C13 and C15 directly contact each other, a good magnetic coupling between the primary winding C12 and C14 and the secondary winding C11, C13 and C15 can be obtained.

In the flat transformer shown in FIG. 11, when the primary windings C12 and C14 are connected in parallel, the secondary winding C13 and C15 is connected to in series, and the secondary winding C11 is used in single state, an output having a ratio of 1:2 and an output having a ratio of 1: 1 1 can be obtained.

Further, in the embodiment the flat transformer can have one insulated conducting wire C11 used as the primary winding and the remaining four insulated conducting wires C12, C13, C14 and C15 used as the secondary winding.

Figure 12A:
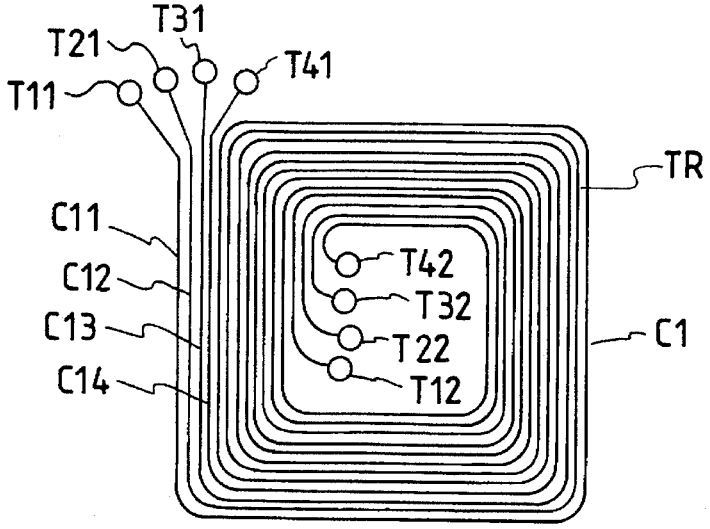
FIG. 12A is a plan view showing a further embodiment of a winding construction for a flat transformer according to the present invention.

FIG. 12A is a plane view showing a further conductor arrangement for a flat transformer constituted by four insulated conducting wires C11, C12, C13 and C14 according to the present invention.

Each of the four insulated conducting wires C11, C12, C13 and C14 are wound on a square shaped frame member at the same time, and thereby the arrangement may be used to form a flat transformer TR having a square shape, which is flat and thin. In this embodiment, a coil body C1 of the flat transformer TR is formed by four insulated conducting wires C11, C12, C13 and C14, which are wound in contact with each other.

Figure 12B:
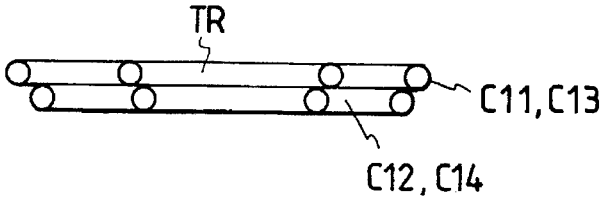
FIG. 12B is a cross-sectional view of a conductor construction arrangement of the winding construction as shown in FIG. 12A.

Each of the four insulated conducting wires C11, C12, C13 and C14 has the same conducting wire diameter. The two insulated conducting wires C11 and C12 and the two insulated conducting wires C13 and C14 are disposed in two stages as shown in FIG. 12B. Namely, the two insulated conducting wires C11 and C13 are disposed in an upper stage on the same plane and the two insulated conducting wires C12 and C14 are disposed in a lower stage on the same plane.

The two insulated conducting wires C11 and C12 are shifted with respect to each other by a substantial half diameter of the insulated conducting wire, and the two insulated conducting wires C13 and C14 are shifted with respect to each other by a substantial half diameter of the insulated conducting wire.

A terminal T11 is provided on one end of the insulated conducting wire C11 and a terminal T12 is provided on another end of the insulated conducting wire C11. A terminal T21 is provided on one end of the insulated conducting wire C12 and a terminal T22 is provided on another end of the insulated conducting wire C12. A terminal T31 is provided on one end of the insulated conducting wire C13 and a terminal T32 is provided on another end of the insulated conducting wire C13. A terminal T41 is provided on one end of the insulated conducting wire C14 and a terminal T42 is provided on another end of the insulated conducting wire C14.

According to this embodiment of the present invention, in addition to the effects of the above stated embodiment of FIG. 5, when this flat transformer construction TR is assembled into another apparatus, the presence of a useless space can be avoided, and the flat transformer TR can be arranged easily. In other words, when the flat transformer TR is employed as a power supply unit, the arrangement between the flat transformer TR and other components mounted on the power supply unit can be effected easily, and by arranging plural flat transformers an having the winding arrangement of FIG. 17A useless space can be avoided, thereby the space factor in the power supply unit can be improved.

Figure 13:
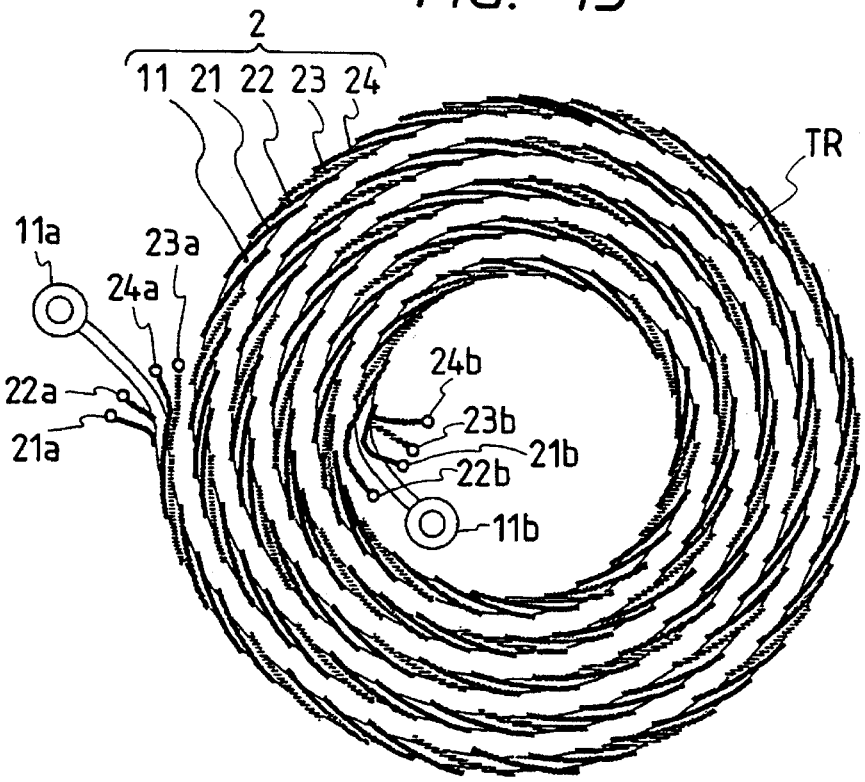
FIG. 13 is a plan view showing a further embodiment of a winding construction for a flat transformer according to the present invention.

FIG. 13 is a plan view showing a further embodiment of a winding arrangement for a flat transformer according to the present invention.

In FIG. 13, the flat transformer 1 is constituted by winding spirally and concentrically a complex conductive wire 2 in the same plane. The concentrically and spirally complex conductive wire 2 comprises one insulated large current conducting wire 11 and four insulated small current conducting wires 21, 22, 23 and 24.

In this embodiment, the insulated large current conducting wire 11 is used as the primary winding and the insulated small current conducting wires 21, 22, 23 and 24 are used to form the secondary winding.

A constructive example of the concentrically and spirally the complex conductive wire 2 will be explained with reference to FIG. 14. The large current conducting wire 11 is formed as an axis member, and at an outer peripheral portion of the large current conducting wire 11 four small current conducting wires 21, 22, 23 and 24 are wound concentrically and spirally.

According to the above stated construction of the concentrically and spirally complex conductive wire 2, the geometrical positioning relationship of each of the four small current conducting wires 21, 22, 23 and 24 is substantially the same with respect to the large current conducting wire 11. Accordingly, the differences of the magnetic coupling efficiency and the leakage inductance between each of the four small current conducting wires 21, 22, 23 and 24 is small.

In this embodiment of the flat transformer TR according to the present invention, as shown in FIG. 13, for example, by means of an external wiring process, a terminal 21*b* of the secondary winding 21 is connected to a terminal 22*a* of the secondary winding 22, a terminal 22*b* of the secondary winding 22 is connected to a terminal 23*a* of the secondary winding 23 and a terminal 23*b* of the secondary winding 23 is connected to a terminal 24*a* of the secondary winding, 24.

The total length of the electric wire between the terminal 21*a* of the secondary winding to the terminal 24*b* of the secondary winding is about four times the total length of the electric wire between a terminal 11*a* of the primary winding and a terminal 11*b* thereof.

Figure 14:
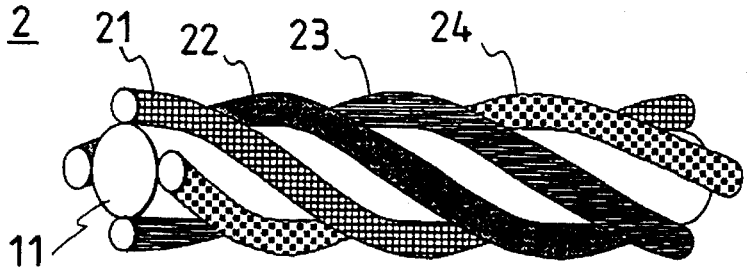
FIG. 14 is a perspective view showing a concentrically and spirally complex conductive wire of the type used in FIG. 13.

When a high frequency current flow in the complex conductive wire 2 shown in FIG. 14, due to surface effect, a good magnetic coupling between the primary winding and the secondary winding can be obtained and the leakage magnetic flux can be reduced. The coupling of the magnetic flux amount between the primary winding and the secondary winding can be about 1:4, and so the voltage ratio of the flat transformer can be about 1:4.

Further, it is possible to use all or a part of the secondary windings 21, 22, 23 and 24 as individual secondary windings, resulting in a multi-winding flat transformer having plural secondary windings per one primary winding.

Figure 15:
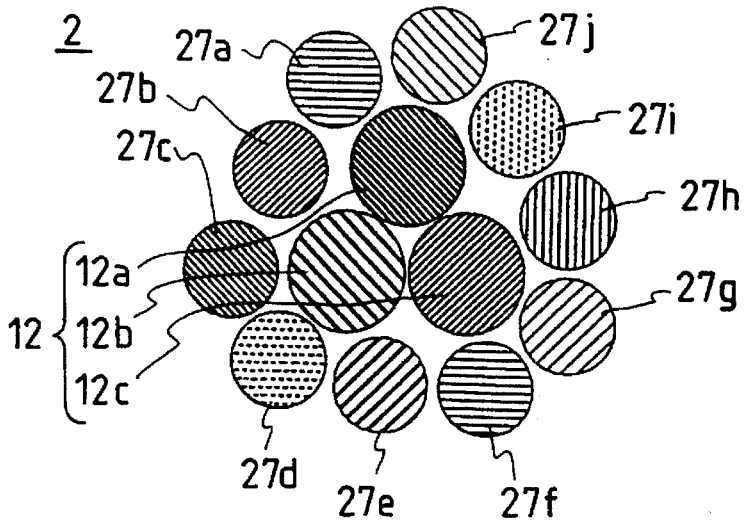
FIG. 15 is a cross-sectional view showing another form of a concentrically and spirally complex conductive wire.

FIG. 15 shows a modified example of a conductor arrangement for a flat transformer shown in FIG. 13.

In FIG. 15, a concentrically and spirally complex conductive wire 2 is formed by concentrically and spirally winding conductive wires. The concentrically and spirally complex conductive wire 2 comprises three large diameter current conducting wires 12*a*, 12*b* and 12*c* and ten smaller diameter current conducting wires 27*a*, 27*b*, . . . , 27*j*.

Three large current conducting wires 12*a*, 12*b* and 12*c* are formed as an axis member and, at an outer peripheral portion of the large current conducting wires 12*a*, 12*b* and 12*c*, ten small current conducting wires 27*a*, 27*b*, . . . , 27*j* are wound spirally.

Herein, as three strands 12*a*, 12*b* and 12*c* of the large current conducting wires, insulated conductive wires may be used, or by using bare wires and assembling the three bare wires, an insulated layer may be formed between the small current conducting wires 27*a*, 27*b*, . . . , 27*j* and the assembled bare wires.

Further, in the three strands 12*a*, 12*b* and 12*c* of the large current conducting wires, it does not matter if a transposition of the wires exists.

According to the above embodiment of the present invention, since the cross-sectional area necessary to arrange the large current conducting wires can be maintained and further the strand diameter can be small, a complex conductive wire 2 having a small rigidity and large flexibility can be constituted.

Further, due to the working characteristic in which the flat transformer is constituted by spirally windings the complex conductive wire 2, a flat transformer having the small inner diameter can be manufactured.

When the strands 12*a*, 12*b* and 12*c* are using a insulated coating film on the conductive wire, the generation of an eddy current flowing over each of the strands 12*a*, 12*b* and 12*c* can be prevented, and accordingly the loss reduction and the efficiency of the flat transformer can be improved.

Figure 16:
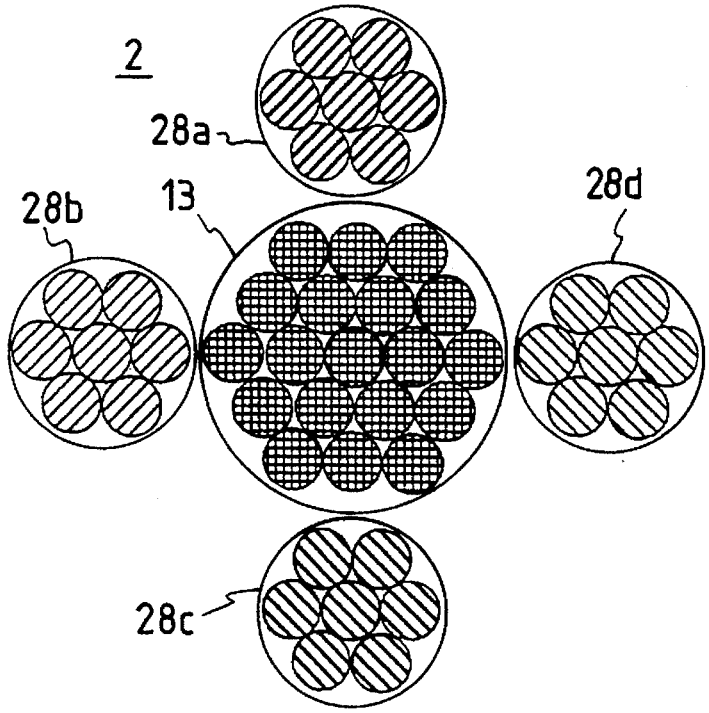
FIG. 16 is a cross-sectional view showing a further form of a concentrically and spirally complex conductive wire.

FIG. 16 shows a modified example of a conductor arrangement for a flat transformer as shown in FIG. 13.

In FIG. 16, a concentrically and spirally complex conductive wire 2 is formed by winding concentrically and spirally plural conductive wires. The concentrically and spirally complex conductive wire 2 comprises a large current conducting wire 13 and four small current conducting wires 28*a*, 28*b*, 28*c* and 28*d*.

Each of the four small current conducting wires 28*a*, 28*b*, 28*c* and 28*d* is constituted by a thin multi-strand congregating wire. The large current conducting wire 13 is formed as an axis member, and, at an outer peripheral portion of the large current conducting wire 13, the four small current conducting wires 28*a*, 28*b*, 28*c* and 28*d* are wound spirally.

According to the above embodiment of the present invention, in comparison with a case in which each of the conducting wires is constituted by a single wire, since the cross-sectional area of each of the conducting wires is a same, the complex conducting wire 2 having a small rigidity can be constituted. A spiral shaped flat transformer having a small inner diameter can be manufactured with a good working characteristic.

Further, since each of the strands is formed by a wire having an insulated coating film, the effective resistance increase due to the surface effect during a high frequency current flow condition and the loss increase due to eddy currents can be prevented, and accordingly the efficiency in the flat transformer can be improved.

In FIG. 16, both the conductive wire diameter of the strand forming the large current conducting wire 13 and the four small current conducting wires 28*a*, 28*b*, 28*c* and 28*d* have the same conductive wire diameter. However, the conductive wire diameter of the strand forming the large current conducting wire 13 may be different from the conductive wire diameter of the strands forming the four small current conducting wires 28*a*, 28*b*, 28*c* and 28*d*.

Figure 17A:
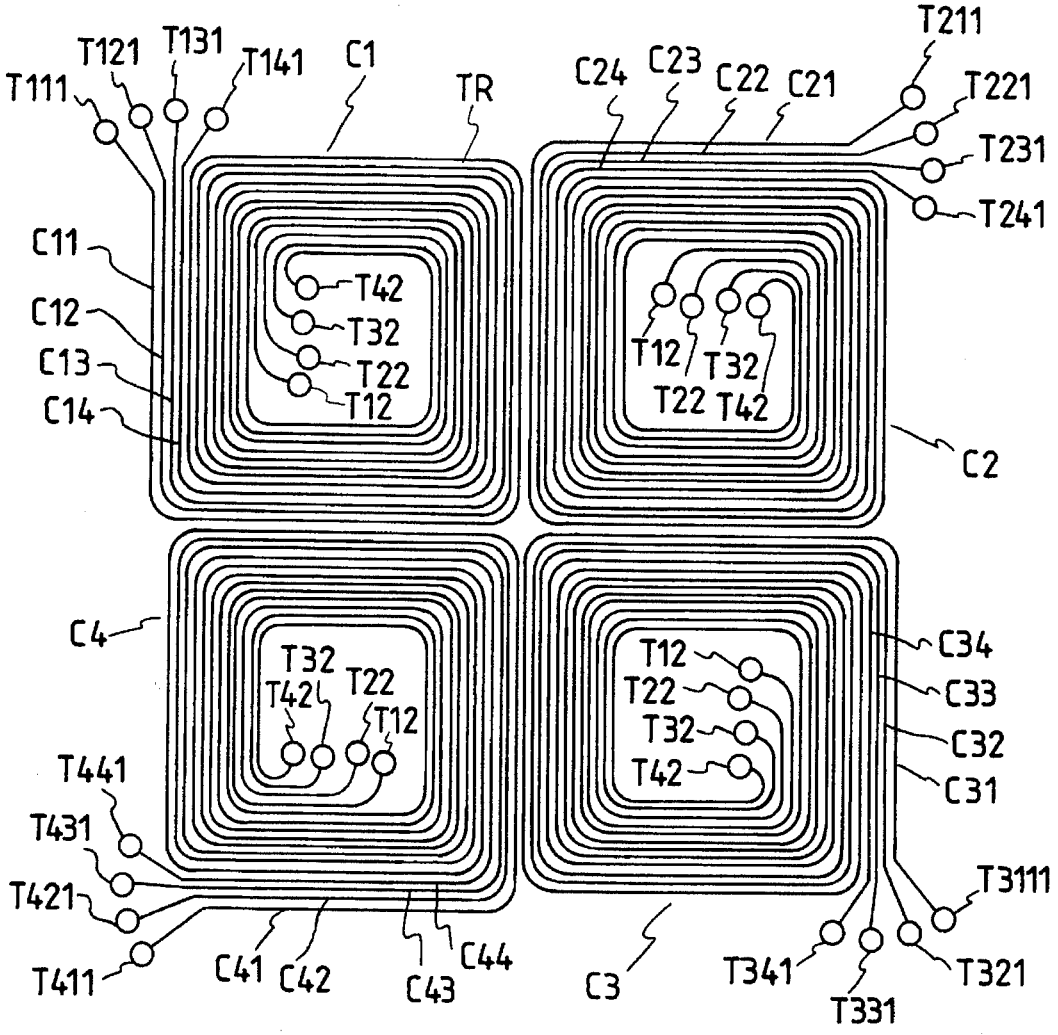
FIG. 17A is a plan view showing a further embodiment of a winding construction for a flat transformer according to the present invention.

FIG. 17A shows a further winding construction for a flat transformer according to the present invention.

In FIG. 17A, complying with the specification of a flat transformer TR, four square shaped coil bodies C1, C2, C3 and C4 are disposed, each of four coil bodies C1, C2, C3 and C4 has the square coil body C1 as shown in FIG. 12A. In this embodiment, the two coil bodies C1 and C4 and the two coil bodies C2 and C4 are arranged respectively vertically and the two coil bodies C1 and C2 and the two coil bodies C3 and C4 are arranged respectively horizontally. The four coil bodies C1, C2, C3 and C4 are arranged with no clearance.

According to the above stated embodiment shown in FIG. 17A , since each of four coil bodies C1, C2, C3 and C4 is arranged with a dispersing form, the coil bodies C1, C2, C3 and C4 can have a size by which they may be easily formed and such coil bodies C1, C2, C3 and C4 can be arranged as a flat transformer construction TR; accordingly, the coil bodies C1, C2, C3 and C4 can be easily mass-produced.

Figure 17B:
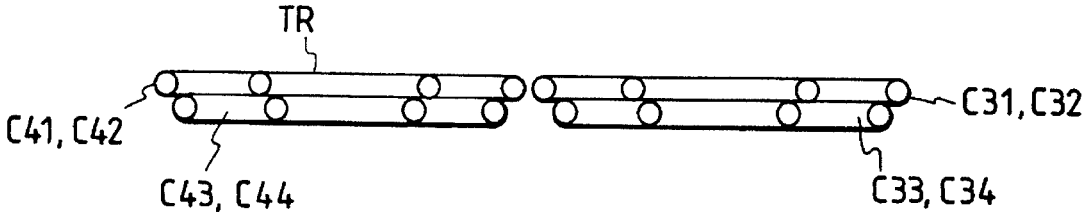
FIG. 17B is a cross-sectional view showing a conductor construction arrangement of the winding construction shown in FIG. 17A.

As shown in FIG. 17B, the conducting wires comprising of the four insulated conducting wires C31, C32, C41 and C42 and the conducting wires comprising the four insulated conducting wires C33, C34, C43, C44 are disposed in two stages as shown in FIG. 12B. Four insulated conducting wires C31, C32, C43 and C44 are shifted by a substantial half diameter with respect to the four insulated conducting wires C33, C34, C34 and C44.

Further, the four insulated conducting wires C11, C12, C21 and C22 and the four insulated conducting wires C13, C14, C23, C24 may be disposed in two stages (not shown in the figure). The four insulated conducting wires C11, C12, C21 and C22 a substantial half diameter with respect to the four insulated conducting wires C13, C14, C23 and C24 (not shown in the figure).

In the above embodiment shown in FIG. 17A, each of the coil bodies has a square shape. However, plural coil bodies having a circular shape, as shown in FIG. 1A, may be used and in this flat transformer construction the above stated effects shown in FIG. 17A can be obtained.

Figure 18:
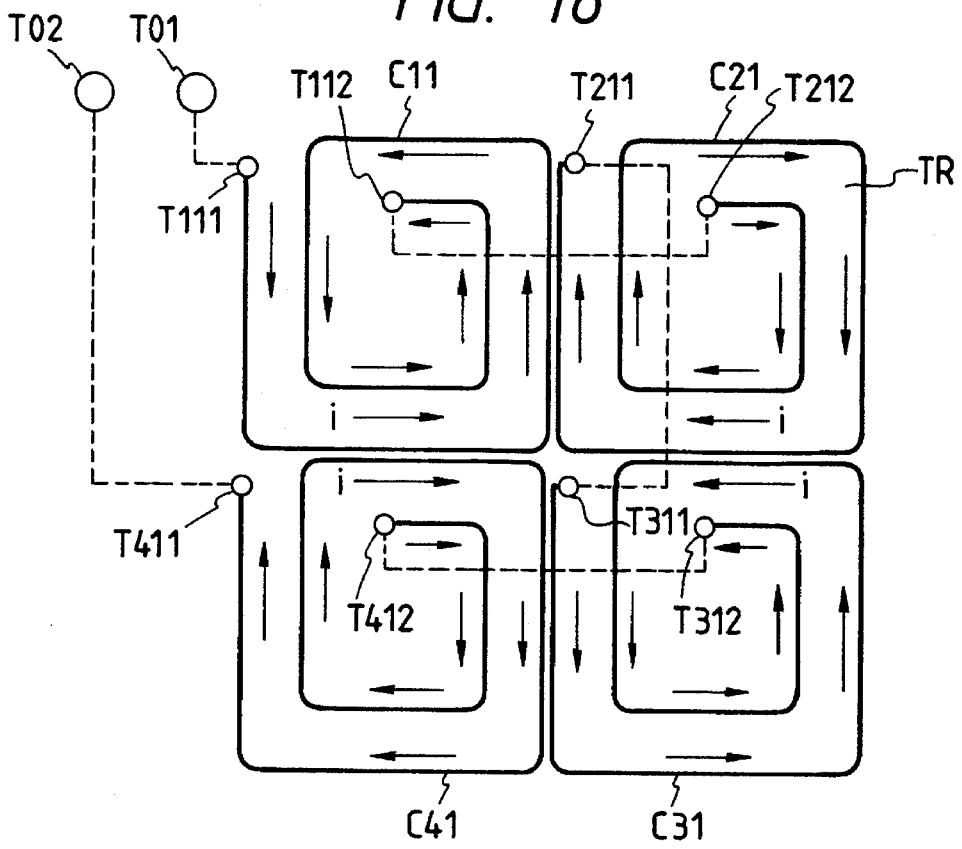
FIG. 18 is an electric connection arrangement view of a flat transformer according to the present invention.

FIG. 18 shows an electrical connection relationship for a flat transformer having the winding arrangement of FIG. 17A according to the present invention.

In a flat transformer TR, an optimum arrangement and the electric connection of the four coil bodies C1, C2, C3 and C4 shown in FIG. 17A is exemplified. In FIG. 18, so as to make it easy to understand, only the primary windings C11, C12, C13 and C14 are shown to illustrate the arrangement and the electrical connection. The secondary windings are omitted from this FIG. 18, however the electric connection of the secondary windings is the same as the electric connection of the primary windings.

In FIG. 18, four coil bodies C1, C2, C3 and C4 having the same shape are exemplified. In this figure an external terminal T111 of the coil body C1 of a first conductor C11 is connected to a main terminal T01, an internal terminal T112 of the coil body C1 of the first conductor C11 is connected to an internal terminal T212 of the coil body C2 of a second conductor C21, and an external terminal T211 of the coil body C2 of the second conductor C21 is connected to an external terminal T311 of the coil body C3 of a third conductor C31.

An internal terminal T312 of the coil body C3 of the third conductor C31 is connected to an internal terminal T412 of the coil body C4 of a fourth conductor C41 and an external terminal T411 of the coil body C4 of the fourth conductor C41 is connected to a main external terminal T02.

As stated above, the external terminal of the former coil body is connected successively to the external terminal of the next coil body and the internal terminal of the former coil body is connected successively to the internal terminal of the next coil body.

By the above stated electrical connection, as shown in FIG. 18, the conductor C11 and the conductor C21 and the conductor 31 and the conductor C41 each have the same current flow direction in adjacent parts.

Further, since a good magnetic coupling occurs between the primary winding of the conductor C11 and the secondary winding of the conductor C21 and also between the secondary winding of the conductor C11 and the primary winding of the conductor C21, a good magnetic coupling between the primary winding and the secondary winding can be obtained. Further, a good magnetic coupling between the respective coil bodies can be obtained.

Figure 19:
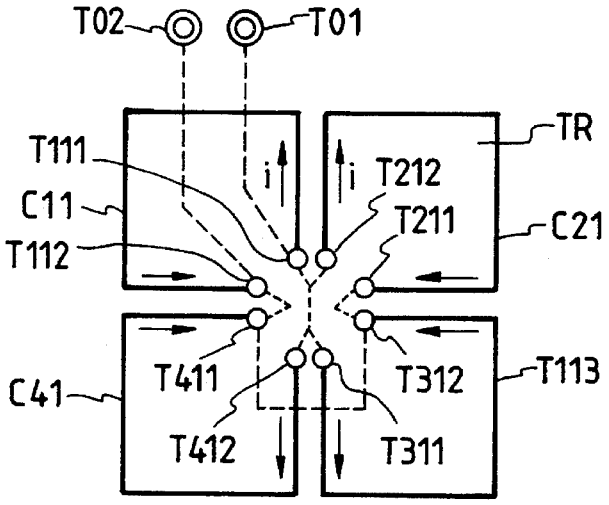
FIG. 19 is an electric connection arrangement view showing a further flat transformer according to the present invention.

FIG. 19 shows a further embodiment of a parallel electrical connection of plural coil bodies according to the present invention. In FIG. 19, four coil bodies having the same shape are arranged, so that the primary winding structure is simplified.

The winding ending terminals T111 and T311 of a first conductor C11 and a third conductor C31 of an odd number of the coil bodies are connected to a main terminal T01, and also the winding starting terminals T212 and T412 of a second conductor C21 and a fourth conductor C41 of an even number of the coil bodies are connected to the main terminal T01.

The winding ending terminals T112 and T312 of the first conductor C11 and the third conductor C31 of an odd number of the coil bodies are connected to a main terminal T02 and also the winding starting terminals T211 and T411 of the second conductor C21 and the fourth conductor C41 of an even number of the coil bodies are connected to the main terminal T02.

When the coil bodies are connected in parallel, as shown in FIG. 19, between the adjacent conductors comprising of the first conductor C11 and the second conductor C21, the current direction is the same as indicated by the arrow. And also, between the adjacent conductors comprising the first conductor C11 and the fourth conductor C41, the current direction is the same as indicated by the arrow.

Accordingly, in this embodiment according to the present invention, in all coil bodies a good coupling between the primary winding and the secondary winding can be obtained.

Figure 20:
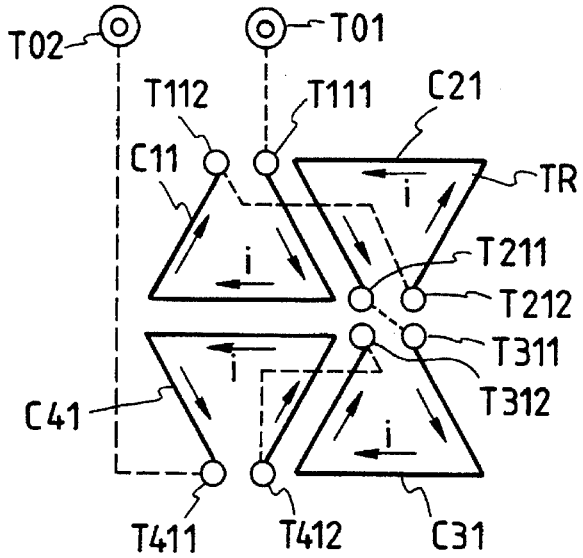
FIG. 20 is an electric connection arrangement view showing still further flat transformer according to the present invention.

FIG. 20 shows a further embodiment of a series electrical connection of plural coil bodies according to the present invention. In FIG. 20, three coil bodies are arranged in a triangular shape, and so the primary winding structure is simplified.

The winding ending (outer side) terminal T111 of a first conductor C11 of the coil bodies is connected to a main terminal T01, and also the winding starting (inner side) terminal T212 of a second conductor C21 is connected to the main terminal T01.

The winding ending terminal T211 of the second conductor C21 is connected to the winding end terminal T311 of the third conductor C31 of the coil body. The winding starting terminal T312 of the third conductor C21 of the coil body is connected to the winding starting terminal T412 of the fourth conductor C41 of the coil body. The winding ending terminal T411 of the fourth conductor C41 is connected to the main terminal T02.

When the coil bodies are connected in series, as shown in FIG. 20, between the adjacent conductors comprising the first conductor C11 and the second conductor C21, the current direction is the same as indicated by an arrow mark. And also, between the adjacent conductors comprising the first conductor C11 and the fourth conductor C41, the current direction is the same direction as indicated by an arrow mark.

Accordingly, in this embodiment according to the present invention, in all coil bodies a good magnetic coupling between the primary winding and the secondary winding can be obtained.

Figure 21:
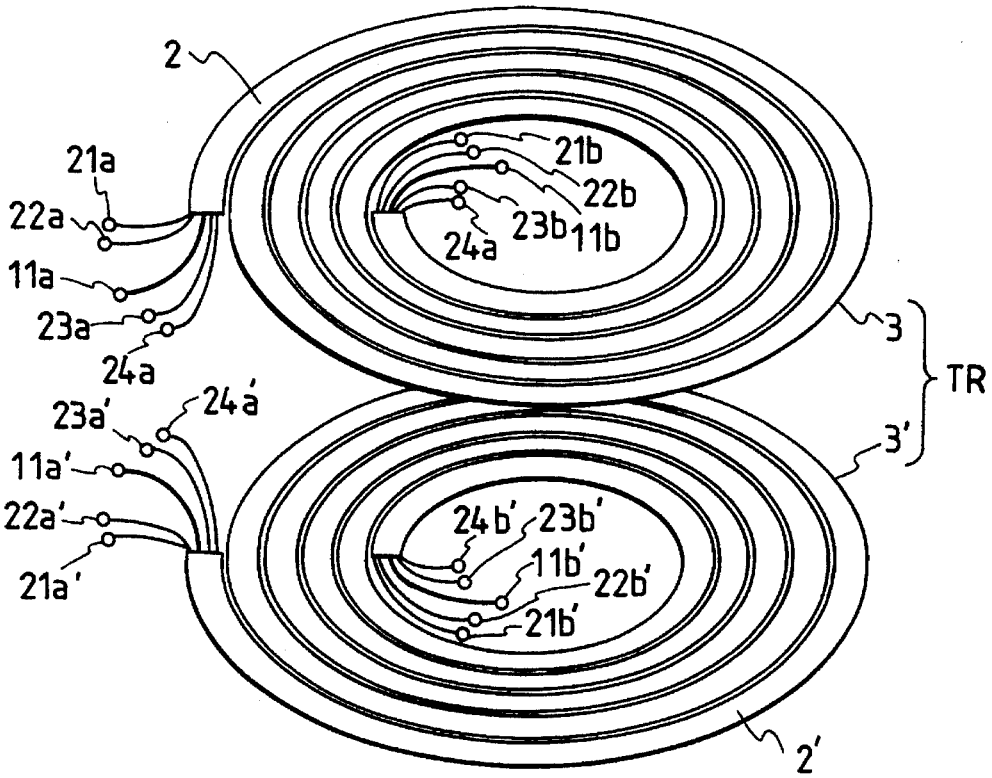
FIG. 21 is a perspective view showing a flat transformer having a pair of complex conductive wires according to the present invention.

FIG. 21 shows a further arrangement of plural coil bodies for a flat transformer according to the present invention. In this arrangement, a flat transformer TR is constituted by a coil body 3 and a coil body 3'. A concentrically spiral complex conductive wire 2 is wound spirally to form the coil body 3 and a concentrically spiral complex conductive wire 2' is wound spirally in an opposite direction to form the coil body 3'. A flat transformer TR is constituted by overlapping the coil body 3 and the coil body 3'.

In this embodiment, by connecting a terminal **11*b* of the coil body 3 and a terminal 11*b*' of the coil body 3', a large current coil body is formed between an outer peripheral terminal 11*a* of the coil body 3 and an outer peripheral terminal 11*a*' of the coil body 3'**.

In a small current coil body having a large winding number, by connecting respectively a terminal **21*b* and a terminal 21*b*', a terminal 21*a*' and a terminal 22*a*, a terminal 22*b* and a terminal 22*b*', a terminal 22*a*' and a terminal 23*a*, a terminal 23*b* and a terminal 23*b*', a terminal 23*a*' and a terminal 24*a* and a terminal 24*b* and a terminal 24*b*', a coil body is formed between the outer peripheral terminal 21*a* and an outer peripheral terminal 24*a*'**. This coil body has a length of four times the length of the large current coil body.

According to this embodiment, without the connecting wire spreading over the inner and the outer peripheral end of the coil bodies, a predetermined terminal can be formed. As a result, the wiring leading between the circuit substrate for mounting the transformer and the peripheral circuits can be simplified.

In this embodiment, it is not necessary to form separately the coil body 3 and the coil body 3', it can be constituted by winding continuously one concentrically spiral complex conductive wire 2, as a result of which it is unnecessary to bind the inner peripheral end; accordingly the manufacturing process can be simplified and further the reliability can be improved.

In accordance with the present invention, as stated above, the wound body of the electrical conductive wire itself can operate as a high frequency flat transformer TR; however, since there exists no magnetic path, many magnetic fluxes flowing into the peripheral space can be obtained.

Figure 22:
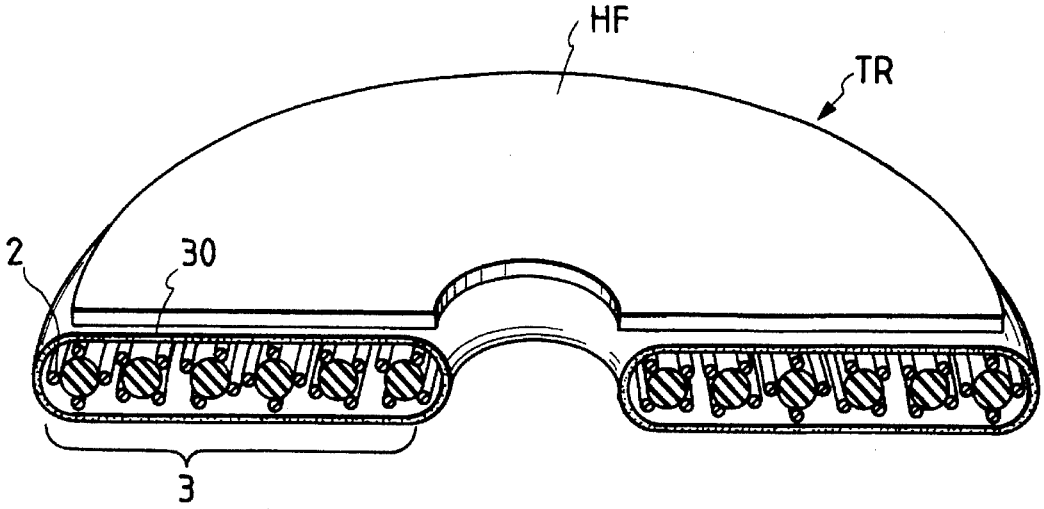
FIG. 22 is a cross-sectional view showing a flat transformer in which a magnetic shielding is provided around the coil bodies.

Further, as shown in FIG. 22, in a flat transformer TR, a magnetic shielding body 30 encloses a coil body 3 comprised of a concentrically spirally complex conductive wire 2, effectively providing a construction in which the magnetic fluxes flowing into the space are reduced.

According to this construction, in addition to the magnetic shielding effect, even in a comparatively low frequency range, the magnetic coupling between the primary winding and the secondary winding can be improved effectively.

The magnetic shielding body 30 of the embodiment shown in FIG. 22 can be constructed by painting a resin material in which magnetic particles, such as ferrite powers and magnetic metal, are mixed, or by winding a tape on which the magnetic particles are painted or coated, on or around a body member.

Further, the magnetic shielding body 30 can be constructed by an amorphous, foil form magnetic material of fine crystallization and a silica steel plate band.

It is not necessary to surround the whole of this magnetic shielding body 30, but it is effective to provide an open magnetic path structure in which a part of the magnetic shielding body 30 is covered.

Further, in FIG. 22, the area surrounding the coil 3 is enclosed by the magnetic shielding body 30 and also a heat dissipation means HF comprising a copper plate is provided. Accordingly, the heat generated in the coil body 3 can be discharged effectively toward the outside.

Figure 23:
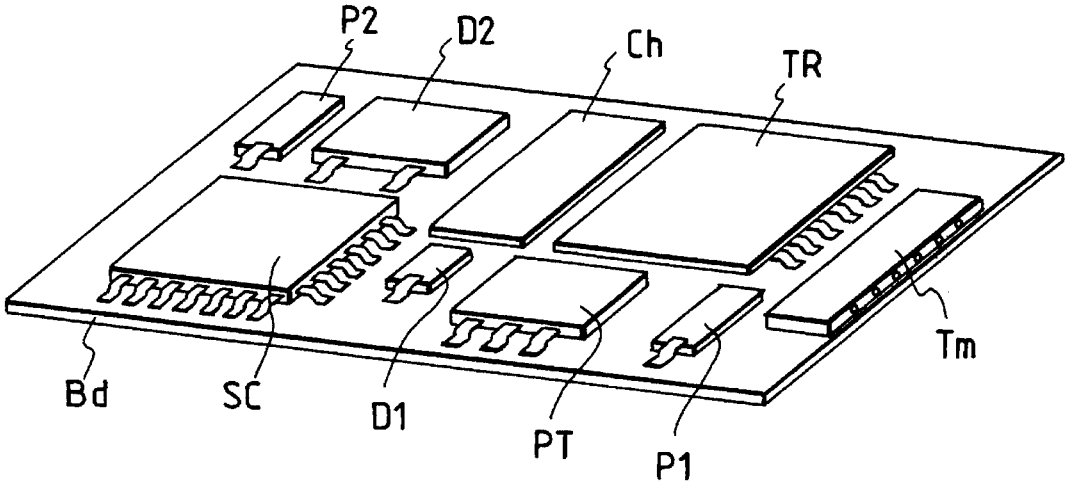
FIG. 23 is a perspective view showing a power supply unit having a flat transformer according to the present invention.
Figure 24:
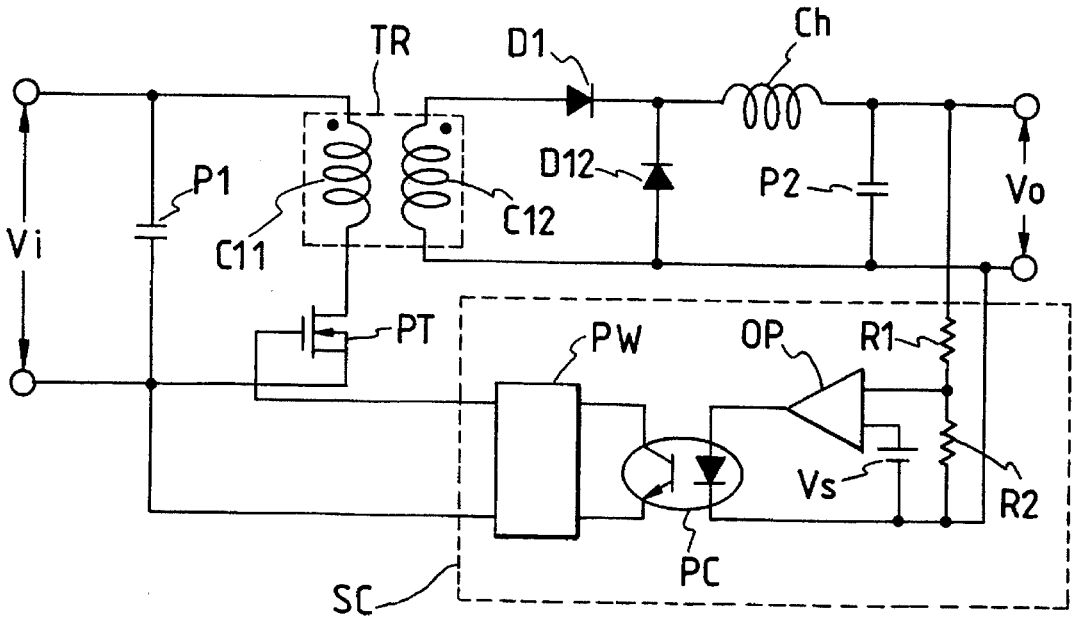
FIG. 24 is a schematic circuit diagram showing a power supply unit having a flat transformer according to the present invention.

FIG. 23 shows an example of one applied construction in which the flat transformer according to the present invention is used in an power supply unit. This power supply unit is a DC/DC converter, and FIG. 24 shows an embodied circuit of the converter.

First of all, referring to FIG. 24 the electrical connection between the flat transformer according to the present invention and other components constituted by this apparatus will be explained.

A direct current voltage Vi is added to an input and a smoothing condenser P1 is connected in parallel with this voltage member. A primary winding C11 of a flat transformer TR and a switching element PT are connected in parallel with the voltage member and the condenser P1.

A secondary winding C12 of the flat transformer TR and a diode D1 are connected in series, and at both ends a diode D12 is connected in series. The diode D12 is connected in parallel to a series connection of a choke coil Ch and a condenser P2. An output voltage Vo is obtained across condenser P2.

Further, so as to stabilize the output voltage Vo, the output voltage Vo is input into a controlling circuit SC and is applied across the series connection of a resistor R1 and a resistor R2. The connecting point between the resistor R1 and the resistor R2 of the controlling circuit SC is connected to an input terminal of an amplifier OP.

Further, to another input terminal of the amplifier OP a standard voltage Vs is connected. At an output of the amplifier OP, an input of a photo-coupler PC is connected. An output of the photo-coupler PC is connected to a pulse width modulator oscillator (PWM OSC) PW, the output there of being connected to a base electrode of the switching element PT.

In FIG. 23, the flat transformer TR, the choke coil Ch, the power element PW, the diodes D1 and D2, the condensers P1 and P2, the controlling circuit SC and an outside connecting terminal Tm are arranged on the same wiring substrate Bd. By the above stated various components, a DC/DC converter is constituted. In this power supply unit construction, as the choke coil Ch, only the primary winding of the above stated flat transformer TR is used.

According to the above stated embodiment of the present invention, on the same substrate member Bd of the semiconductor elements constituting the power supply unit, the flat transformer TR can be mounted; accordingly, the power supply unit can be flat and thin.

Figure 25:
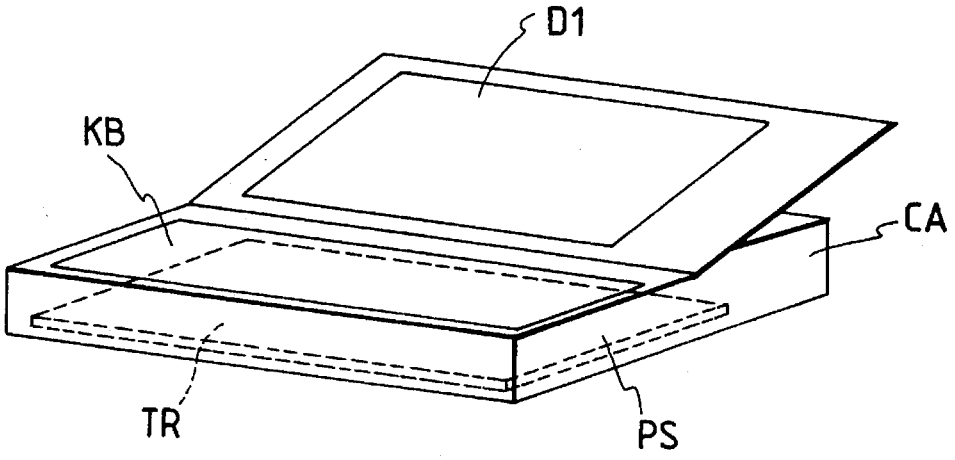
FIG. 25 is a perspective view showing a personal computer having a power supply apparatus according to the present invention.

FIG. 25 shows another applied constructive example in which the power supply unit shown in FIG. 23 is provided on a personal computer.

A display D1 is installed in a cover portion of a a case CA, within which a keyboard DB is also installed by slimming of a power supply unit PS having a flat transformer TR.

In the prior art, the power supply unit (an adapter) of the personal computer is installed outside of the case CA and the wiring of the unit is complicated; however, the above defects can be solved by the present invention.

Further, the application of the power supply unit according to the present invention is not limited to use in a personal computer, as shown in this figure, but it can be used as an information processing system and apparatus, such as a personal and small size office automation system and apparatus, such as a word processor, in which similar effects according to the former embodiments of the present invention can be obtained.

Figure 26:
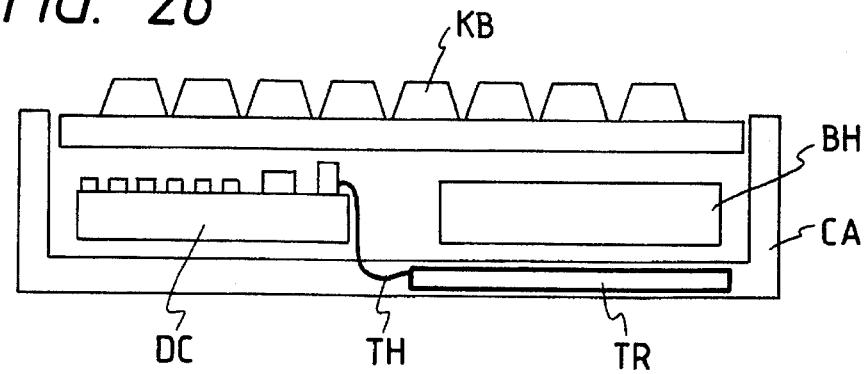
FIG. 26 is a cross-sectional view showing a personal computer system and apparatus having a power supply unit according to the present invention.

FIG. 26 is a cross-sectional view showing one embodiment of the system and apparatus in which the power supply unit according to the present invention is disposed in an office automation apparatus.

In FIG. 26, components BH of the office automation apparatus and a driving circuit DC of the power supply unit PS are disposed between a keyboard KB and a case CA, and a flat transformer TR is embedded into a bottom portion of the case CA and is connected to driving circuit DC by lead wire TH. Accordingly, it is possible to obtain a small size and a thin type apparatus.

Figure 27:
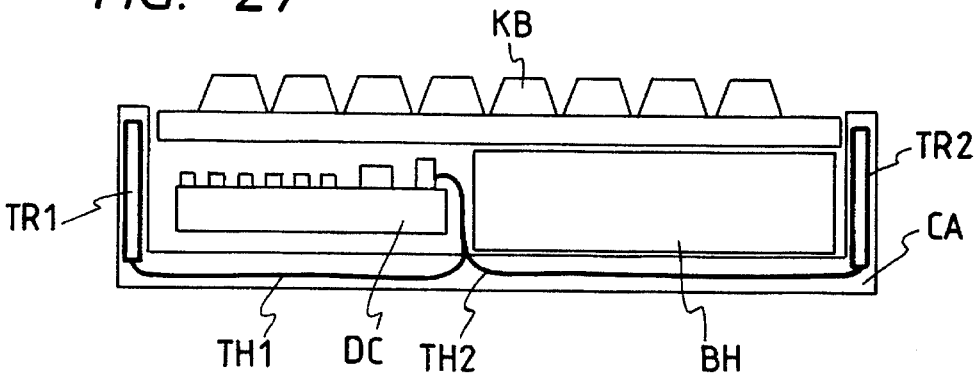
FIG. 27 is a cross-sectional view showing another personal computer system and apparatus having a power supply unit according to the present invention.

FIG. 27 is a cross-sectional view showing another embodiment of a system and apparatus in which the power supply unit according to the present invention is disposed.

In FIG. 27, components BH of the office automation apparatus and a driving circuit DC of the power supply unit PS are disposed between a keyboard KB and a case CA, and two flat transformers TR1 and TR2 are embedded into both side portions of the case CA and are connected to driving circuit DC by lead wires TH1 and TH2. Accordingly, it is possible to obtain a small size and a thin type apparatus.

Figure 28:
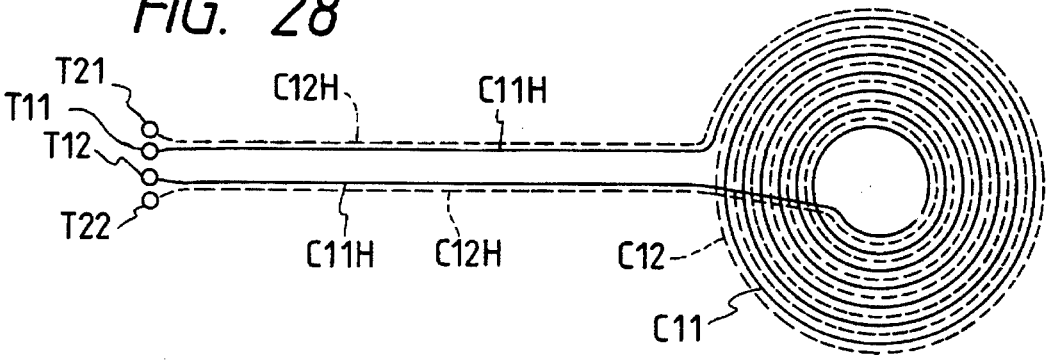
FIG. 28 is a plan view showing a winding construction for a flat transformer having leading wires according to the present invention.

FIG. 28 shows the flat transformer of FIG. 26 and FIG. 27 and a wiring of the flat transformer. Even in a case where the flat transformer is disposed separately from the power supply unit main body, a lead wire C11H of the primary winding C11 and a lead wire C12H of the secondary winding C12 are disposed in close relationship and make up the lead wires TH1 and TH2 of FIG. 27.

According to the above stated power supply unit construction, a good magnetic coupling between the primary windings C11 and the secondary winding C12 can be obtained, and further these winding portions work as voltage converting portions, so that it can be used effectively. Further, as the conductors of the wiring portions, even if a material which is different from the flat transformer is used, since the conductors are disposed in close relationship, similar effects can be obtained.

Figure 29:
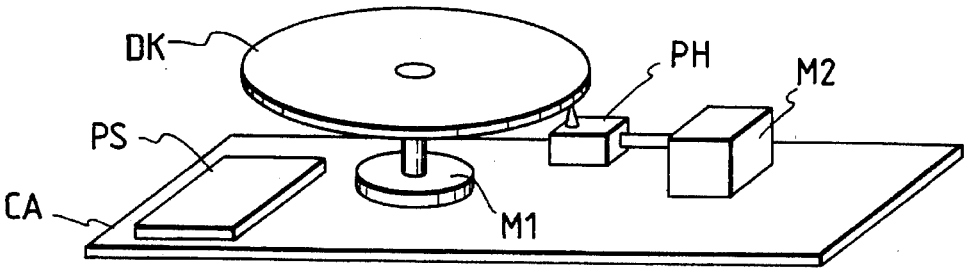
FIG. 29 is a perspective view showing a disk apparatus having a power supply unit according to the present invention.

FIG. 29 is a further view showing one embodiment of a system and apparatus in which the power supply unit according to the present invention is disposed in a compact photo disk apparatus, such as an audio visual system and apparatus.

In FIG. 29, a disk DK is driven by a motor M1 which is installed in a case CA. An input and output of an information into the disk DK are performed by a photo head PH and a head positioning motor M2 moves the photo head PH.

Herein, as the power supply for the motor M1 and the head positioning motor M2, the power supply unit PS according to the present invention is utilized. The power supply unit PS is arranged on the case CA opposite to a head mechanism comprised of the photo head PH and the head positioning motor M2. Accordingly, a slim type apparatus can be obtained.

We claim:

1. A flat transformer, comprising a coil body formed by plural conductors, wherein:

each of said plural conductors is coated by an insulating material;

said coil body is formed as a spiral winding of plural conductors;

a part of said plural conductors form a primary winding of the flat transformer, and the remainder of said plural conductors form a secondary winding of the flat transformer; and each of said plural conductors of said secondary winding contacts at least one of said plural conductors of said primary winding.

2. A flat transformer, comprising plural coil bodies, each coil body formed by plural conductors, wherein:

each of said plural conductors is coated by an insulating material;

each of said plural coil bodies is formed as a spiral winding of plural conductors disposed in a respective plane;

a part of said plural coil bodies form a primary winding of the flat transformer, and the remainder of said plural coil bodies form a secondary winding of the flat transformer; and each of said plural conductors of said secondary winding contacts at least one of said plural conductors of said primary winding.

3. A flat transformer, comprising plural coil bodies, each coil body formed by plural conductors, wherein:

each of said plural conductors is coated by an insulating material;

each of said plural coil bodies is formed as a spiral winding of plural conductors disposed in a respective plane;

a part of said plural conductors form a primary winding of the flat transformer, and the remainder of said plural conductors form a secondary winding of the flat transformer; and each of said plural conductors of said secondary winding contacts at least one of said plural conductors of said primary winding.

4. A flat transformer according to claim 3, wherein:

the centers of the conductors of one of said coil bodies are shifted with respect to the centers of the conductors of an adjacent coil body.

5. A flat transformer according to claim 4, wherein said plural conductors are wound on a bobbin having a stepped configuration.

6. A flat transformer according to claim 5, further comprising:

winding guide plates on an upper face and a lower face of said bobbin, and a terminal for drawing out said conductive wire on at least one of said winding guide plates and said bobbin.

7. A flat transformer according to claim 3, wherein said plural conductors include conductors having at least two different diameters.

8. A flat transformer according to claim 7, wherein a conductor forming part of a secondary winding is smaller in diameter than a conductor forming the primary winding.

9. A flat transformer, comprising a first coil body formed by a complex conductor, wherein:

said complex conductor comprises at least one central insulated conductor and at least one peripheral insulated conductor wound concentrically and spirally on said at least one central insulated conductor;

said first coil body is formed as a spiral winding of said complex insulated conductor; and said at least one central insulated conductor forms a primary winding of said flat transformer, and said at least one peripheral insulated conductor forms at least one secondary winding of said flat transformer.

10. A flat transformer according to claim 9, wherein said central insulated conductor of said complex insulated conductor is constituted by plural conductors.

11. A flat transformer according to claim 9, wherein:

said flat transformer further comprises a second coil body having a winding direction which is reversed with respect to the winding direction of said first coil body, said first coil body is positioned on said second coil body in an overlapping relationship; and each of the conductors of said complex insulated conductor is connected at an inner peripheral end of each of said coil bodies.

12. A flat transformer according to any one of claims 1–11, wherein the cross-section of said conductors of said coil body is of a substantially circular shape.

13. A flat transformer according to any one of claims 1–11, wherein said coil body is enclosed by a magnetic shielding body.

14. A flat transformer according to any one of claims 1–11, further comprising a heat dissipation member on said coil body.

15. A flat transformer according to any one of claims 2–11, further comprising means connecting said plural coil bodies in one of a series connection, a parallel connection, and a series and parallel connection.

16. A flat transformer according to any one of claims 1–11, wherein each of said coil bodies is connected so that the direction of current flow in each primary winding conductor is the same as the direction of current flow in each secondary winding conductor contacting such primary winding conductor.

17. A power supply unit comprising a flat transformer as claimed in any one of claims 1–11, wherein said flat transformer is used as a voltage converting portion.

18. A power supply unit, comprising a substrate member; a power supply circuit component; and a flat transformer as claimed in any one of claims 1–11, said power supply circuit component and said flat transformer being disposed on said substrate member.

19. A portable information processing apparatus, comprising a power supply unit as claimed in claim 18, and one of a personal computer, a word processor, and a disk apparatus.

20. A portable information processing apparatus, comprising a power supply unit as claimed in any one of claims 1–11, and one of a personal computer, a word processor, and a disk apparatus.

21. A portable information processing apparatus according to claim 20, further comprising a case, and wherein said flat transformer is embedded into said case.

22. A portable information processing apparatus according to claim 21, wherein a pair of the primary winding and the secondary winding of the flat transformer connected under the same polarity condition form lead wires of said flat transformer.

23. A flat transformer, comprising a coil body formed by plural conductors, wherein:

each of said plural conductors is coated by an insulating material;

said coil body is formed as a spiral winding of said plural conductors;

a part of said plural conductors form a primary winding of the flat transformer, and the remainder of said plural conductors form a secondary winding of the flat transformer;

the conductors of said primary winding and the conductors of said secondary winding are intermixed with each other, with each conductor of said secondary winding contacting at least one conductor of said primary winding.

24. A flat transformer, comprising a coil body formed by plural conductors, wherein:

each of said plural conductors is coated by an insulating material;

said coil body is formed as a spiral winding of said plural conductors;

a part of said plural conductors form a primary winding of the flat transformer, and the remainder of said plural conductors form a secondary winding of the flat transformer;

each conductor of said secondary winding contacts at least one conductor of said primary winding; and said flat transformer has a magnetic coupling efficiency which abruptly increases at frequencies above 100 KHz.

25. A flat transformer, comprising a coil body formed by plural conductors, wherein:

each of said plural conductors is coated by an insulating material;

said coil body is formed as a spiral winding of said plural conductors;

a part of said plural conductors form a primary winding of the flat transformer, and the remainder of said plural conductors form a secondary winding of the flat transformer;

each conductor of said secondary winding contacts at least one conductor of said primary winding; and said flat transformer has a magnetic coupling efficiency of nearly about 100% at frequencies exceeding 100 KHz.

26. A flat transformer according to claim 1, wherein the conductors of said primary winding have substantially the same diameter as the conductors of said secondary winding.

27. A flat transformer according to claim 1, wherein the primary winding and the secondary winding are closely adhered to and in contact with each other.

28. A flat transformer according to claim 2, wherein the conductors of said primary winding have substantially the same diameter as the conductors of said secondary winding.

29. A flat transformer according to claim 2, wherein the primary winding and the secondary winding are closely adhered to and in contact with each other.

30. A flat transformer according to claim 3, wherein the conductors of said primary winding have substantially the same diameter as the conductors of said secondary winding.

31. A flat transformer according to claim 3, wherein the primary winding and the secondary winding are closely adhered to and in contact with each other.

32. A flat transformer according to claim 23, wherein the conductors of said primary winding have substantially the same diameter as the conductors of said secondary winding.

33. A flat transformer according to claim 23, wherein the primary winding and the secondary winding are closely adhered to and in contact with each other.

34. A flat transformer according to claim 8, wherein:

the conductors of said primary winding have a diameter substantially two times the diameter of the conductors of said secondary winding.

35. A flat transformer according to claim 7, wherein:

the conductors of said primary winding have a diameter substantially ($\sqrt{2-1}$) time the diameter of the conductors of said secondary winding.

* * * * *